United States Patent [19]

Burton

[11] 4,093,286

[45] June 6, 1978

[54] SECURITY LOCKING DEVICE FOR LOUVRE AND JALOUSIE WINDOWS

[76] Inventor: Larry D. Burton, 12232 Waldorf Dr., Lynwood, Calif. 90262

[21] Appl. No.: 663,575

[22] Filed: Mar. 3, 1976

[51] Int. Cl.[2] ..... E05C 19/18

[52] U.S. Cl. ..... 292/259 R; 49/74; 49/395; 292/288

[58] Field of Search ..... 292/345, 288, 289, 258, 292/259; 49/394, 395, 51, 55, 57, 50, 74, 90, 87, 64; 312/216

[56] References Cited

U.S. PATENT DOCUMENTS

| | | | |
|---|---|---|---|
| 376,686 | 1/1888 | Stickney | 292/345 |
| 395,902 | 1/1889 | Heidt | 49/74 |
| 472,985 | 4/1892 | Deats et al. | 292/345 |
| 824,273 | 6/1906 | Ausband | 292/345 |
| 999,682 | 8/1911 | Suits | 49/57 |
| 3,005,671 | 10/1961 | Majeski | 312/216 |

*Primary Examiner*—Kenneth J. Dorner
*Attorney, Agent, or Firm*—Booker T. Hogan, Jr.

[57] ABSTRACT

A series of bracs sized to fit louvre and jalousie glass panes when fitted with a latching unit provides an excellent security or locking device for windows.

2 Claims, 3 Drawing Figures

SECURITY LOCKING DEVICE FOR LOUVRE AND JALOUSIE WINDOWS

BACKGROUND OF THE INVENTION

1. Field of the Invention

This invention is related to the field of security devices in general and to security devices for louvre windows in particular.

2. Prior Art

The need for a means of securing louvre and jalousie windows becomes readily apparent upon an inspection of standard louvre-window hardware. Conventionally such hardware is made of light weight aluminum or a similar alloy which may be pried loose from glass panes inserted therein in order to remove the panes.

Attempts to preclude the removal of glass panes or slats from louvre window hardware have resulted in the design of "Louvre Window Security Clips", By Stay-Safe Security Products, Inc. of Los Angeles, California and a "Louvre Lock" By Sun-Dor Louvre Lock Company of Los Angeles, Calif.

The Stay-Safe System consist of a series of light weight spring steel clips designed to fit over the top of each glass pane and clip under the bottom pane holder thereby precluding one from pushing the glass pane out with an upward force. These clips do not preclude one from pulling the glass pane down, nor do they preclude one from opening the window by forcing the pressure latching mechanism of the louvre window hardware to rotate.

The Sun-Dor product constitutes a significant step toward achieving a totally effective louvre lock system. It precludes one from forcing the window open and from forcing the glass panes out by the exertion of an upward force. However, this system does not preclude one from working the panes out by prying the louver latches away from the bottom of the glass panes to remove the panes by the exertion of a downward force. The Sun-Dor device has an added disadvantage over the present invention in that it is considerably more difficult to attach and remove than the present invention.

Neither applicant nor his attorney is aware of other devices which serve or are intended to serve the functions of the present invention.

THE INVENTION

Summary

In seeking to overcome the deficiencies of the above described prior art in providing a solution to the problem of security where there are louvre or jalousie windows, it is an object of this invention to provide a totally effective security device for louvre and jalousie windows. A further objective is to provide a security device that is easily mounted in place and removed. A still further objective of the invention is to provide a security device that is relatively inexpensive and easy to manufacture.

In meeting these objectives a security device has been designed and fabricated that exhibits none of the disadvantages of the prior art.

This device consist of a multiplicity of semi elliptical shaped rings or "Bracs" which fit around each glass pane placed in standard louvre window hardware. Each ring contains two flanges on one side which prevent it from being continuous and thereby easily installed on existing windows. A single elongated flat member having a multiplicity of openings or slots cut out of one of its sides is used to latch each ring in a closed position by placing each pair of flanges in a slot and exerting a downward force to move the latch to a locked position.

When this device is installed on a louvre or jalousie window installation, it becomes impossible to remove the glass panes without breaking them out or manipulating the louvre operator to cause the panes to open. However, the rings or brac do not preclude the window from functioning normally when the latch is not in place.

BRIEF DESCRIPTION OF THE DRAWING

The novel features which are characteristic of the invention both as to its organization and method of operation, together with advantages thereof will be better understood from the following description considered in connection with the accompanying drawings in which like characters refer to like parts and in which.

DETAILED DESCRIPTION OF THE INVENTION

In seeking to provide a security device for louvre window and door installations capable of preventing surreptitious intrusions by the sequential removel of glass slats from the louvre hardware which exhibits none of the disadvantages of prior art devices, a device has been designed and fabricated from light weight metals called a "Brac-Latch".

Whereas other security devices either fail to preclude the removal of glass slats from the slat retainer hardware completely or do so only partially after a cumbersome attachment procedure, the "Brac-Latch" is completely effective and easily attached because of its simplicity.

Figure 1:
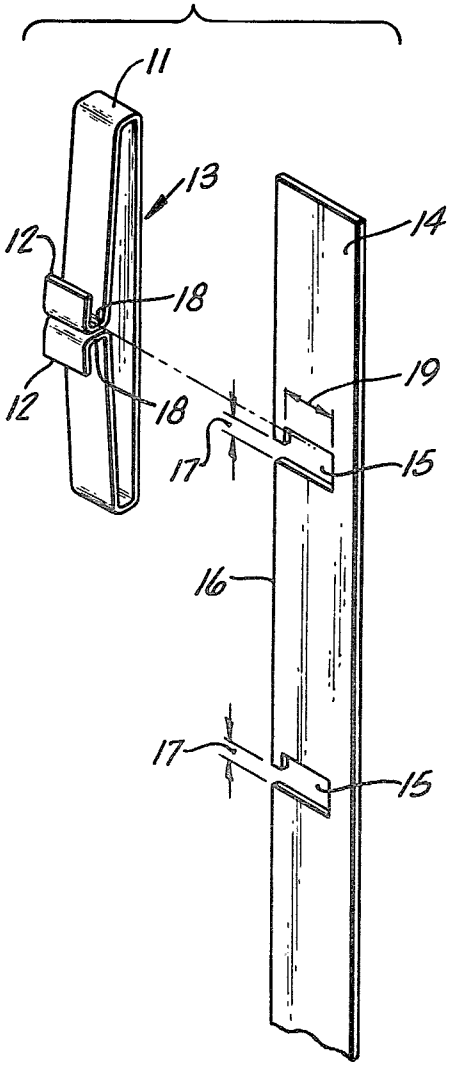
FIG. 1 is a perspective view of two elements of the invention, the "Brac" and its "Latch"

The device is composed of two separate elements which when mounted in place combine to preclude one from forcing the louvre window into an opening position or removing individual glass slats from the louvre hardware. The first element in reality is a multiplicity of separate elements labled "Bracs". They are fabricated from thin strips of metal formed to wrap around a rectangular shaped glass slat or pane. Referring to FIG. 1, the ends of each strip or "Brac" 11 are formed into two opposing flanges 12. "L" shaped flanges are preferred. However "J" shaped flanges may be used. Each "Brac" is mounted on a glass slat so that the flanges 12 of the "Brac" 11 will be on the inside of the panes when they are in a closed position in the louvre hardware. The front portion 13 of the "Brac" is a continuous strip which faces outward when the slat or pane is in a closed position in the louvre hardware. Light weight stainless steel is the preferred construction meterial. However, other light weight metals or hard plastic materials may also be used. Such materials include, but are not limited to, aluminum, copper, tungsten, bakelite, or teflon.

The second element of the system, labled a "Latch" or latching means 14, is an elongated flat member containing a multiplicity of openings refered to as "Cut Outs" or "Slots" 15 extending from one edge 16 to essentially the center of the member. These slots are characterized by a short thin elongated primary section 17 which extends from the edge of the latch 16 to a rectangular shaped secondary section 19 positioned essentially in the center of the latch 14.

The primary section 17 is sized to fit smoothly over the bases 18 of the flanges 12. This allows the flanges to slip into the secondary section 19 when the latch is placed in position.

The secondary section 19 may be from 1 to 2 times wider then the primary section 17 and must extend into the center of the latch deeper than the width of the Brac flanges 12 at their bases 18 in order to accomodate the flanges.

Each slot or cut out is placed in a predetermined spaced relationship with the latch. This relationship is based on the spacings between the flanges of each brac. In a conventional louvre window, the distance between slots will be approximately 3 inches if each brac is formed about the glass pane so that the flanges meet in the center of the pane or at some other identical position on each pane.

The "Latch" element of the system may be constructed from any rigid material whose modules of elasticity exceeds the rupture strength of the glass used as panes or slots. Aluminum has been found to be very effective. Other metals and hard plastics may be used.

Figure 2:
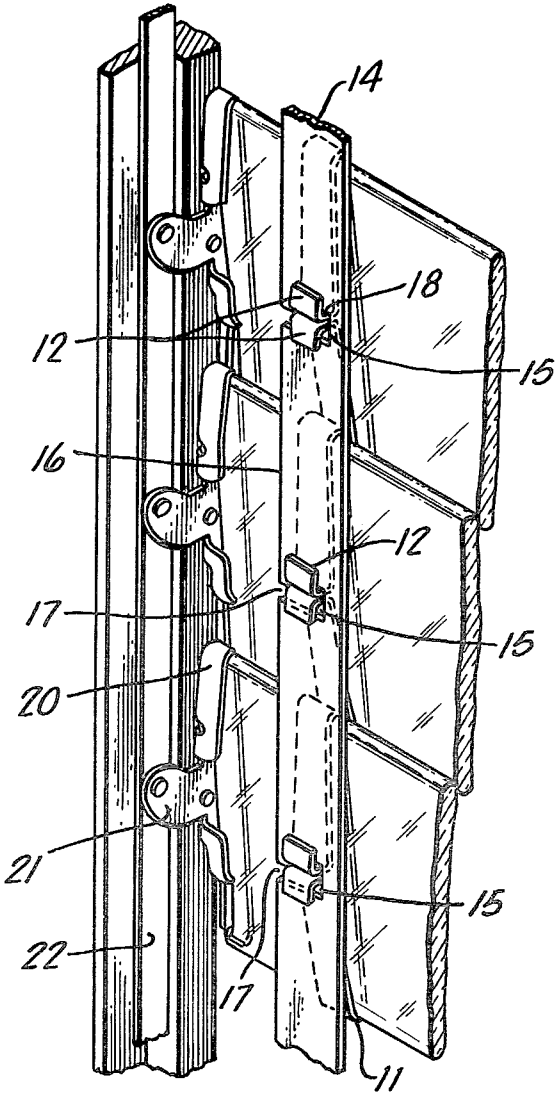
FIG. 2 is a perspective view of the invention as it appears from the inside of a louvre window installation on which it has been applied.

In operation, one simply places a "Brac" about each glass pane in the louvre window or door hardware. These "Bracs" will not interfere with the operation of the window or door about their rotation points 21 of the hardware 22 until the "Latch" is placed in position as shown in FIG. 2. When attached, the latch 14 will preclude the rotation of the glass panes because of the interaction of the bracs 11 and their flanges 12. This principle may be understood upon examination of FIGS. 2 and 3 which show the system as applied to a louvre window installation.

Figure 3:
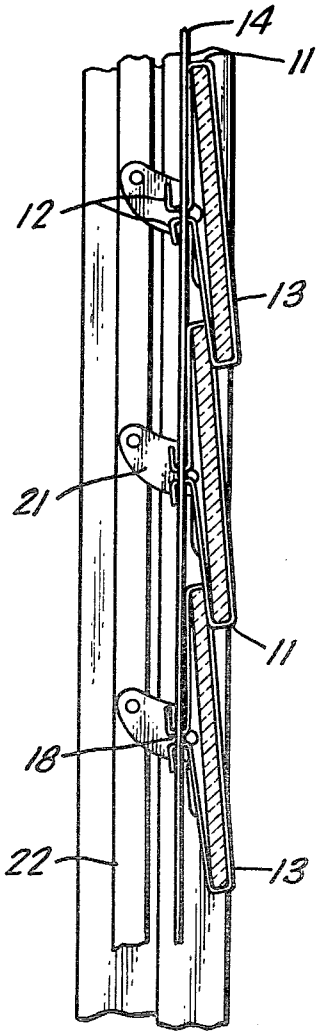
FIG. 3 is a side view of the invention as it appears when applied to a louvre window installation.

It will also be evident from an examination of FIGS. 2 and 3 that the Brac-Latch System will also preclude the removal of the glass slots or panes from the light weight louvre brackets 21 by the exertion of either a upward or downward force as is the practice where no security system is present.

Having disclosed my invention and described, in terms which teach others having similar skills, how to make and use it, the scope and nature of my claims may be understood as follows:

I claim:

1. A security system for louvre and jalousie windows and/or doors having a multiplicity of glass slats or panes, said system comprised of:

a multiplicity of thin metallic bracs, that are formed in the shape of a rectangle having long and short sides whereby one of the long sides is uninterrupted while the other long side is interrupted intermediate said short sides to form two flanges having first and second portions, said first portions extending outward from said interrupted side to join with said second portions, said second portions extending substantially perpendicular to said first portions, each of said brac wrapping around each of said glass slats or panes; and a latching means comprised of an elongated rigid flat member having a multiplicity of openings on one side in a predetermined space relationship based on the location of said brac flanges on said panes, whereby said openings of said latching means mates with said first portions of said bracs thereby forming a stationary integrated brac-latch system which precludes the removal of said glass panes or slats from said louvre window or door.

2. The system of claim 1 wherein said openings in said latching means are characterized by a short thin elongated primary section extending from the edge of said flat member to a rectangular shaped secondary section positioned essentially in the center of said flat member.

* * * * *